United States Patent [19]

Shaw, Jr.

[11] Patent Number: 4,467,545

[45] Date of Patent: Aug. 28, 1984

[54] PERSONALIZED SAFETY METHOD AND APPARATUS FOR A HAND HELD WEAPON

[76] Inventor: Frederic A. Shaw, Jr., 87 Bond St., W. Gloucester, Mass. 01930

[21] Appl. No.: 407,346

[22] Filed: Aug. 12, 1982

[51] Int. Cl.[3] ..... F41C 17/00; F41C 17/08

[52] U.S. Cl. ..... 42/70 R; 42/1 LP

[58] Field of Search ..... 42/1 LP, 70 R; 340/146.3 E, 146.3 AG

[56] References Cited

U.S. PATENT DOCUMENTS

| | | | |
|---|---|---|---|
| 3,581,282 | 5/1971 | Altman | 340/149 |
| 3,781,855 | 12/1973 | Killen | 340/146 |
| 3,939,679 | 2/1976 | Barker et al. | 70/277 |
| 3,978,604 | 9/1976 | Smith | 42/70 |
| 4,003,152 | 1/1977 | Barker et al. | 42/70 R |
| 4,015,240 | 3/1977 | Swonger et al. | 340/146.3 E |
| 4,032,889 | 6/1977 | Nassimbene | 340/146.3 E |
| 4,067,132 | 1/1978 | Smith | 42/66 |
| 4,105,885 | 8/1978 | Orenstein | 200/52 R |
| 4,107,775 | 8/1978 | Ott | 364/413 |
| 4,110,928 | 9/1978 | Smith | 42/66 |
| 4,135,320 | 1/1979 | Smith | 42/70 |
| 4,154,014 | 5/1979 | Smith | 42/70 |
| 4,186,378 | 1/1980 | Moulton | 340/146.3 E |

*Primary Examiner*—Charles T. Jordan

*Attorney, Agent, or Firm*—Lahive & Cockfield

[57] ABSTRACT

A hand held weapon is fitted with a safety device responsive to the palm or fingerprint of one or more individuals. The safety device is activated by heat sensed when the device is hand held. Unless the palm or fingerprint of the person holding the device matches a prestored pattern, a blocking safety mechanism, normally preventing operation of the weapon, is maintained in its "blocking state" and the weapon will not fire.

10 Claims, 2 Drawing Figures

PERSONALIZED SAFETY METHOD AND APPARATUS FOR A HAND HELD WEAPON

The invention relates generally to hand held weapons and in particular to a method and apparatus for preventing the unauthorized firing of a hand held weapon.

BACKGROUND OF THE INVENTION

There is a well-recognized need to control or prevent the undesired firing of a weapon, such as a revolver, by an unauthorized individual. Many accidental shootings occur when a weapon is fired by an individual who is not in proper possession of the weapon. For example, there are numerous instances of children finding revolvers in their parents' "hiding places", and accidentally firing the weapon, sometimes critically injuring either themselves or playmates. Just as important, from time to time, a law enforcement officer will have his weapon fall into the possession of an unauthorized individual or even used against him during an altercation. In these instances, it is clearly desirable that the weapon be made so that it will not and cannot be fired by the child or felon.

There have been many attempts to provide a "personalized" firearm. Typically, the method or apparatus provides the user with a special device compatible with the firearm so that unless the user has the device, for example a special ring on the finger, the weapon will not fire. While these methods and apparatus will work, they require the user to be certain that the special operating device is available. Further, however, whoever has the operating device is in a position to fire the weapon. The weapons therefore can be fired by the child or felon if they are aware enough to employ the necessary "key".

Therefore an object of this invention is a method and apparatus whereby a hand held weapon can by fired by at most a known plurality of individuals irrespective of the circumstances surrounding the possession of the weapon. A further object of the invention is a method and apparatus for firearm safety which has a low manufacturing cost, which is simple for the user to operate, and which provides maximum reliability that the firearm will not be operable by an unauthorized individual.

SUMMARY OF THE INVENTION

The invention relates generally to a method and apparatus for preventing the unauthorized firing of a hand held weapon. The apparatus features a blocking member for blocking normal operation of the weapon, a scanning circuit for scanning a portion of the hand of an individual who may grasp the weapon, a comparison circuit for comparing the scanned portion with at least one pattern, the patterns characterizing authorized users of the weapon, and the comparison circuitry operating the blocking member to render the weapon operable when a satisfactory comparison is achieved. Thereby, unauthorized use and operation of the weapon is prevented.

In another aspect of the apparatus, there is further featured an actuation circuit responsive to grasping of the weapon for energizing the various comparison and scanning circuitry. Preferably, the actuation circuit is responsive to heat for determining when the weapon is being grasped.

In accordance with the method of the invention, there is featured the steps of blocking operation of the weapon absent a valid recognition of the individual handling the weapon, comparing a portion of the hand grasping the handle of the weapon with at least one predetermined pattern characterizing authorized users of the weapon, and unblocking operation of the weapon when a valid recognition is determined.

BRIEF DESCRIPTION OF THE DRAWINGS

Other objects, features, and advantages of the invention will become apparent from the following description of a preferred embodiment thereof taken together with the figures in which.

DESCRIPTION OF A PREFERRED EMBODIMENT

Figure 1:
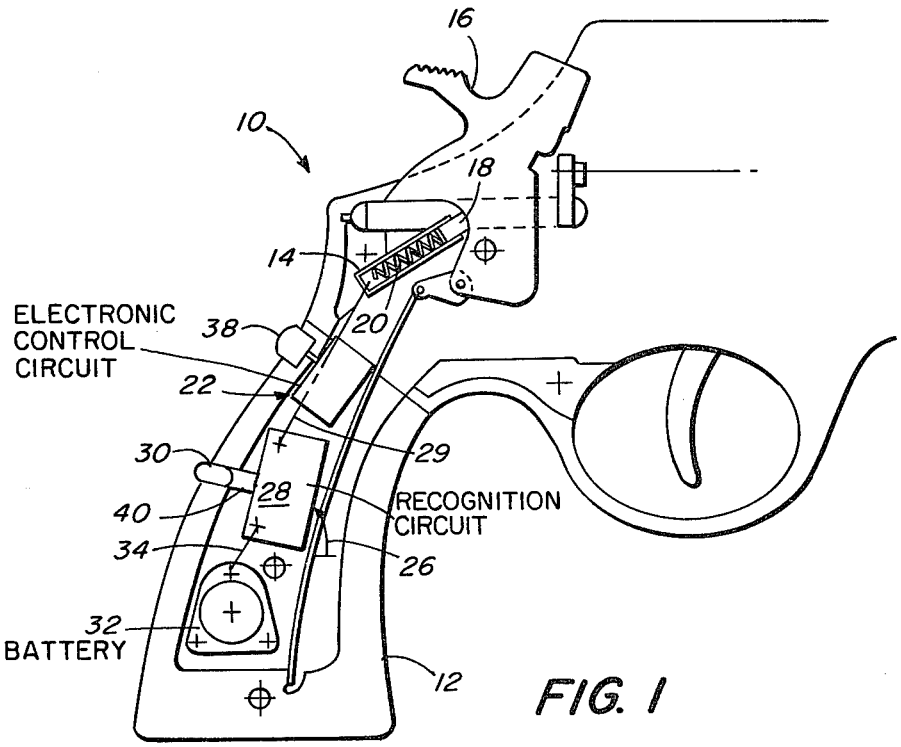
FIG. 1 is a schematic cutaway view of the handle of a revolver showing the incorporation of the invention therein.

Referring to FIG. 1, a hand held weapon, such as a revolver 10, is constructed so that unless the proper input characteristics of the palm or finger are recognized by circuitry contained in the handle 12 thereof, the gun is prevented from being fired by a blocking mechanism. In the preferred embodiment of the invention, solenoid or electromagnet 14 is mounted inside the weapon handle for selectively blocking the firing actuating movement of a weapon part. In the illustrated embodiment, the electromagnet 14 is mounted near the hammer element 16 for blocking movement of the hammer which occurs during and is necessary for the normal operation of the gun. The electromagnet employs a movable armature blocking member 18, normally biased by a spring 20 for engagement with the hammer 16 of the weapon. Unless the armature member is pulled away, the hammer cannot operate and the gun will not fire.

The electromagnet is controlled by electronic circuitry 22 responsive to an electronic scanning element 24. Scanning element 24 has an output 26 applied to a recognition circuit 28 in which has been previously stored the palm or fingerprints of the person(s) authorized to fire the weapon. Circuitry 22 is responsive to recognition circuit 28 over lines 29 for controlling solenoid 14.

The particular recognition circuit 28 employed forms, by itself, no part of the present invention, and it is therefore considered sufficient to point out that recognition circuitry and circuits for recognizing and comparing or matching fingerprints and palm prints are available and within the skill of those skilled in that art. Similarly, the scanning element 24, by itself, forms no part of the present invention and is a commercially available optical scanning device capable of scanning an image at for example a resolution of 100 points per inch. Typical elements are made by for example Reticon Inc. and Fairchild Semiconductor Inc.

The circuitry 28 is turned on in response to a signal from a heat sensing element 30 which is mounted on the surface of the handle of the revolver. The heat sensing member is responsive to body heat such as that available when the handle is grasped for firing. In response to the "turn-on" signal from the heat sensing member 30, circuitry 28 causes scanning element 24 to scan the fingerprint or palm print (preferably the palm print) of the individual holding the weapon. If the scanned pattern belongs to one of those individuals authorized to fire the weapon, the solenoid 14 is actuated to unblock the weapon operation, in the illustrated embodiment, by moving the blocking mechanism away from its blocking relationship to the hammer mechanism. The weapon can then be fired.

Power for the electrical circuitry is provided by a battery 32 contained in the handle. Battery 32 is connected to circuitry 28 over lines 34. Because of the critical nature of the battery to operation of the weapon, a low battery signal, for example a light 38, is provided from the electrical circuitry when battery power is low.

Figure 2:
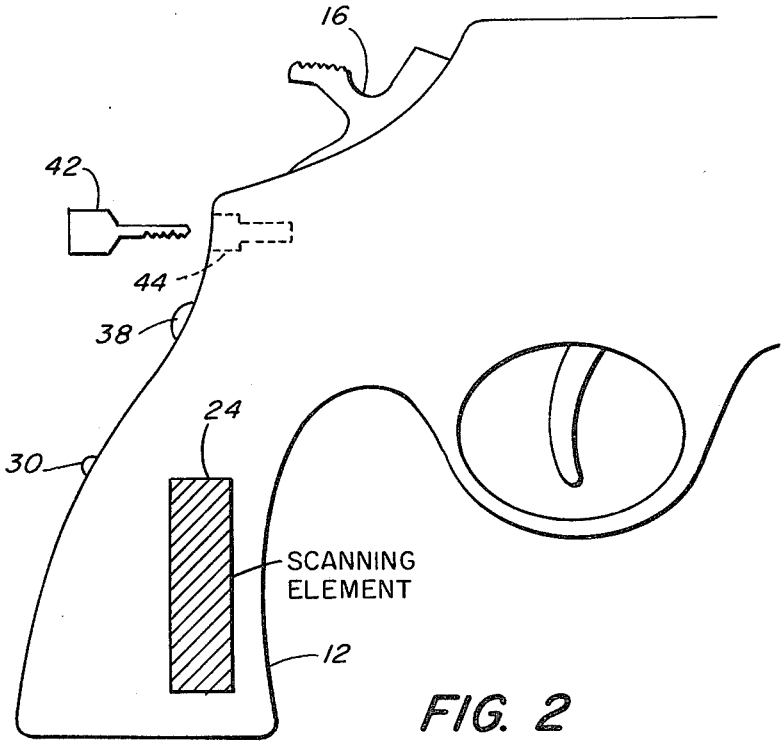
FIG. 2 is a schematic elevation view of the handle of a revolver.

Referring to FIG. 2, the illustrated sensor for the palm print is shown, for example, on the surface of the weapon so that the palm is normally positioned directly over it. The sensor output is connected to the analysis circuit 28, which operates as is well known in the recognition art.

In the embodiment wherein fingerprints are recognized, the fingerprint sensing element is mounted even with the surface of the revolver handle so that one or more of the fingers of the individual will press against the scanning mechanism when the revolver is grasped in its normal manner. Thereby, the fingerprint(s) can be checked for "authorization" so that the weapon can be immediately fired.

The apparatus can further be provided with a keyed manual override feature whereby the blocking member 18 can be disabled by insertion of a "key" 42 into a receptacle 44 in the revolver handle. The key can be operative to withdraw the blocking member from its interfering relationship, in the illustrated embodiment, with the hammer.

Additions, subtractions, deletions, and other modifications of the described embodiment will be apparent to those practiced in the art and are within the scope of the following claims:

I claim:

1. Apparatus for preventing the unauthorized firing of a hand held weapon comprising:

means for blocking normal operation of the weapon, means for scanning a portion of the hand of an individual grasping the weapon, means for comparing said scanned portion with at least one pattern, said one pattern characterizing an authorized user of the weapon, said comparing means operating said blocking means to render said weapon operable when a satisfactory comparison is achieved, whereby unauthorized use and operation of the weapon is prevented.

2. The apparatus of claim 1 wherein said blocking means is resiliently urged into a blocking condition in its unenergized state thereby preventing operation of the weapon.

3. The apparatus of claim 2 wherein said scanning device scans a palm print of the individual grasping the weapon.

4. The apparatus of claim 2 wherein the scanning means scans at least one fingerprint of the individual grasping the weapon.

5. The apparatus of claim 1 further comprising means responsive to the grasping of the weapon for energizing said comparison and scanning means.

6. The apparatus of claim 5 wherein said responsive means comprises means responsive to heat for determining that said weapon is being grasped.

7. The apparatus of claim 5 further comprising means for providing a signal indicating a low battery power cell.

8. The apparatus of claim 6 further comprising keyed manual override means for bypassing the blocking means for rendering the weapon operative upon insertion of a proper key.

9. A method for preventing the unauthorized firing of a hand held weapon comprising the steps of blocking operation of said weapon absent a valid recognition of the individual handling the weapon, comparing a portion of the hand grasping the handle of the weapon with at least one predetermined pattern characterizing authorized users of the weapon, and unblocking operation of the weapon when said valid recognition is determined, whereby unauthorized firing of the weapon is prevented.

10. The method of claim 9 further comprising the step of sensing the grasping of said weapon by sensing the heat emitted by a hand grasping the weapon whereby energization of a remaining operating circuitry is achieved.

* * * * *